US005459486A

United States Patent [19]

Iverson et al.

[11] Patent Number: 5,459,486

[45] Date of Patent: Oct. 17, 1995

[54] METHOD AND APPARATUS FOR COMBINING PALETTES OF COLOR QUANTIZED IMAGES

[75] Inventors: Vaughn S. Iverson, Beaverton, Oreg.; Eve A. Riskin, Seattle, Wash.

[73] Assignee: University of Washington, Seattle, Wash.

[21] Appl. No.: 228,694

[22] Filed: Apr. 18, 1994

[51] Int. Cl.[6] ..... G09G 5/06

[52] U.S. Cl. ..... 345/153; 345/199; 395/131

[58] Field of Search ..... 382/17; 395/131; 348/32–34, 172; 358/29, 81, 82; 345/199, 150, 119, 153

[56] References Cited

U.S. PATENT DOCUMENTS

| | | | |
|---|---|---|---|
| 4,794,386 | 12/1988 | Bedrij et al. | 345/119 |
| 4,862,389 | 8/1989 | Takagi | 345/119 |
| 5,068,723 | 11/1991 | Dixit et al. . | |

OTHER PUBLICATIONS

Iverson, Vaughn S., Riskin,. Eve A.; "A Fast Method for Combining Palettes of Color Quantized Images"; ICASSP Apr. 27, 1993.

Iverson, Vaughn S., Riskin, Eva A.; "A Fast Method for Combining Palettes . . . " Paper Summary; (Unpublished).

Iverson, Vaughn; "Using Vector Quantization Algorithms for Choosing and Combining Palettes for Color Quantized RGB Images;" Jun. 9, 1992 (Unpublished).

Iverson, Vaughn S.; "A Fast Method For Combining Palettes of Color Quantized Images;" Jan. 27, 1993 (Unpublished).

Gray, Robert M.; "Vector Quantization;" IEEE ASSP Magazine, Apr. 1984.

Equitz, William H.; "A New Vector Quantization Clustering Algorithm;" IEEE Transactions on Acoustics, Speech and Signal Processing, vol. 37, No. 10; Oct. 1989.

Gentile et al.; "A Comparison of Techniques for Color Gamut Mismatch Compensation;" Journal of Imaging Tech; vol. 16, No. 5, Oct. 1989.

Orchard et al.; "Color Quantization of Images" IEEE Transactions on Signal Processing; vol. 39, No. 12; Dec. 1991.

Balasubramanian et al.; "A New Approach to Palette Selection for Color Images;" Journal of Imaging Technology, vol. 17, No. 6, Dec. 1991.

Bottemiller, Robert L.; "Commonets on 'A New Vector Quantization Clustering Algorithm';" IEEE Transactions on Signal Processing, vol. 40, No. 2, Feb. 1992.

(List continued on next page.)

*Primary Examiner*—Richard Hjerpe
*Assistant Examiner*—Lun-Yi Lao
*Attorney, Agent, or Firm*—Steven P. Koda

[57] ABSTRACT

A color-mapped display sub,stem efficiently combines palettes of multiple images into a single shared palette. As each image already received a degree of distortion during conventional palette selection, it is desirable to minimize further distortion during the palette combination method of this invention. A pairwise nearest neighbor (PNN) technique is used for combining colors from respective palettes to minimize further distortion. For a final 256-color shared palette, up to 256 (n–1) individual vector merges are performed (where n is the number of image palettes being combined). In one embodiment, two vectors are chosen at each step that yield the lowest increase in distortion when merged. A mean squared error distortion measure of gamma-corrected values defined in YIQ space is used to compare distortion. Searching time at each step is reduced from $O(N^2)$ to $O(N)$, while also eliminating the need for extensive recalculation of color pair distortions between steps. Efficiency is enhanced because the matrix effectively caches distortion calculations between steps. One advantage of the invention is the ability to service run-time demands for the simultaneous display of multiple images on a personal computer or workstation platform having an 8-bit color-mapped display subsystem. Another advantage is the maintenance of image quality across similar multiple images using a shared palette.

4 Claims, 4 Drawing Sheets

OTHER PUBLICATIONS

Wu, Xiaolin; "Color Quantization by Dynamic Programming and Principal Analysis;" ACM Transactions on Graphics, vol. 11, No. 4; Oct. 1992.

Horowitz, E., Sahni, S. "Fundamentals of Computer Algorithms," Computer Science Press, 1978 pp. 98, 108–109.

Taylor, R. et al "Color Image Digitization For Real Time Video Processing".

103

| | $C_1$ | $C_2$ | $C_3$ | | $C_{n*k}$ |
|---|---|---|---|---|---|
| $C_1$ | D(1,1) | D(1,2) | D(1,3) | ••• | D(1,n*k) |
| $C_2$ | D(2,1) | D(2,2) | D(2,3) | ••• | D(2,n*k) |
| $C_3$ | D(3,1) | D(3,2) | D(3,3) | ••• | D(3,n*k) |
| $C_4$ | D(4,1) | D(4,2) | D(4,3) | ••• | D(4,n*k) |
| $C_5$ | D(5,1) | D(5,2) | D(5,3) | ••• | D(5,n*k) |
| ⋮ | ⋮ | ⋮ | ⋮ | | ⋮ |
| $C_{(n*k)-1}$ | D((n*k)-1,1) | D((n*k)-1,2) | D((n*k)-1,3) | ••• | D((n*k)-1,n*k) |
| $C_{n*k}$ | D(n*k,1) | D(n*k,2) | D((n*k),3) | ••• | D(n*k,n*k) *k) |

FIG.5

105

FIG.6

| | MATE COLOR | MIMIMUM DISTORTION |
|---|---|---|
| $C_1$ | $C_3$ | D(1,3) |
| $C_2$ | $C_1$ | D(2,1) |
| $C_3$ | $C_4$ | D(3,4) |
| $C_4$ | $C_5$ | D(4,5) |
| $C_5$ | $C_{n*k}$ | D(5,n*k) |
| ⋮ | ⋮ | ⋮ |
| $C_{(n*k)-1}$ | $C_{50}$ | D((n*k)-1,50) |
| $C_{n*k}$ | $C_4$ | D(n*k,4) |

METHOD AND APPARATUS FOR COMBINING PALETTES OF COLOR QUANTIZED IMAGES

FEDERAL FUNDING STATEMENT

This invention was made with government support under grant numbers MIP-9110508 and MIP-9257587 awarded by the U.S. National Science Foundation. The U.S. government has certain rights in the invention.

A portion of the disclosure of this patent document contains material which is subject to copyright protection. The copyright owner has no objection to the facsimile reproduction by anyone of the patent document or the patent disclosure as it appears in the public Patent and Trademark Office file or records, but otherwise reserves all copyright rights whatsoever.

BACKGROUND OF THE INVENTION

This invention relates to a method and apparatus for displaying color image data. More particularly this invention relates to a computer which executes palette management software for servicing run-time demands for displaying multiple images simultaneously. Respective palettes for the images are combined in real time, while minimizing image degradation.

The use of color image data is a growing trend in personal and workstation computing. Until recent years, the hardware needed to achieve adequate image quality and image manipulation performance has been prohibitively expensive for the typical personal computer or workstation user. The introduction of less expensive color-mapped display subsystems has led to the development of many color image applications. Following is background information on color display subsystems, palette selection techniques, pixel mapping techniques and palette management techniques. The inventive subject matter herein is directed toward improved palette management techniques in a color-mapped display subsystem.

Color Display Subsystems

Color monitors are capable of displaying images at a specified resolution (e.g., 1280×1024; 1024×768). The 1280×1024 resolution monitor, for example, displays an image using 1280 rows of pixel elements by 1024 columns of pixel elements. The illuminated pixels are perceived in total as a color image. In a color monitor each pixel is composed of three smaller elements (called phosphors): one red, one green and one blue. The color of the pixel is determined by mixing the individual intensities of the red, green and blue (RGB) phosphors. In a computer environment, a digital signal drives the display to define the RGB intensities of each pixel. Each pixel is driven to define one of some finite number of colors as determined by an internal representation of an image within a computer's display hardware. Most display subsystems represent colors internally as 24-bit, 18-bit or 16-bit numbers. Often the bit pattern comprises subsets of the R, G and B components comprising the pixel color. For example, a 16-bit color often is represented by 5 bits of the red component, 6 bits of the green component and 5 bits of the blue component. An image occupying the entire display on a 16-bit color subsystem could require 1280×1024×16 bits of memory. A system storing an entire image in a buffer at maximum resolution is a full-color display subsystem. To achieve the high resolution of a full-color display subsystem, many megabytes of expensive VRAM are required.

Color-mapped display subsystems differ from full-color display subsystems by trading resolution to reduce memory needs. Specifically, resolution and memory requirements are decreased by restricting the image on a screen to a palette of a fixed number of colors. The conventional 8-bit color-mapped display subsystem uses a 256-color palette. For colors having 18-bit resolution the palette color-map table requires 4608 bits. For colors having 24-bit resolution the color-map table requires 6144 bits. A full color look-up table, however, requires space for 262,144 potential 18-bit colors or 16.7 million potential 24-bit colors.

To achieve high image quality or efficient image manipulation or substitution, a color-mapped subsystem requires effective palette selection and effective pixel mapping. If a palette is selected ineffectively or pixels are mapped ineffectively, poor image quality is observed.

Typically, palette selection is performed when an image is scanned into a computer system. Alternatively, a utility program converts a full-color image into an 8-bit color-mapped image. The color-mapped image is stored as a 256-color palette and an image bit-map of 8-bit indexes. Each index points to a color in the palette. When the image is to be displayed, the palette is loaded into a color-map table hardwired or integral to a video processor. The image bit-map then is output with each stored index value pointing to a color to be generated at the corresponding pixel.

Following are background sections on palette selection techniques and pixel mapping techniques. Thereafter, the palette management problem is defined.

Palette Selection Techniques

Given a picture with potentially millions of colors in it, how does one select and distribute a color map of 256 colors that are representative of the original image so that it looks "right" when viewed only with those colors in the color map. According to one common method, histogram clustering, it is assumed that the most significant colors will tend to cluster together when their lower order bits are truncated. A histogram of these reduced colors shows occurrences of the reduced colors. The 256 colors with the highest histogram values are taken as a representation of the colors in the image.

A more effective approach is vector quantization. According to vector quantization, palette selection is a data compression problem. The potentially millions of colors in the original picture are compressed to a representative set of 256 colors. Vector quantization is described generally in "Vector Quantization;" by Robert M. Gray, *IEEE ASSP Magazine*, April 1984. Vector Quantization as applied to image compression is described in "A New Vector Quantization Clustering Algorithm" by William H. Equitz, *IEEE Transactions on Acoustics, Speech and Signal Processing*, Vol. 37, No. 10, October 1989. Vector Quantization as applied specifically to palette selection is described in (1) "A New Approach to Palette Selection for Color Images;" by Balasubramanian et al.; *Journal of Imaging Technology*, Vol. 17, No. 6, December 1991; and (2) "Color Quantization of Images;" by Orchard, et al.; *IEEE Transactions on Signal Processing*, Vol. 39, No. 12, December 1991. According to the vector quantization methods, an RGB image is analyzed as a set of 3-dimensional vectors (each vector representing a pixel comprising 3 phosphors—red, green and blue). Palette selection then is the vector quantization problem of choosing an optimal 8-bit codebook of 256 vectors which effectively compresses a given image's potentially millions of colors down to 256 colors.

Equitz describes the generalized Lloyd algorithm of Linde, Buzo and Gray (also referred to as the LBG algorithm) for defining a codebook based on a set of training vectors (e.g., an initial set of pixel colors forming the color image). A starting codebook is selected, then each training vector (pixel color) is assigned its best fit based on a distortion measure. Next, for a given subset of vectors assigned to a code, the code is modified to minimize the distortion error among the vectors assigned to it. Iterations occur of assigning vectors based on fit and modifying the vectors to minimize error. A weakness of Lloyd's algorithm is that the selection of the initial codebook impacts the final result. Equitz proposes a pairwise nearest neighbor (PNN) algorithm to select the initial codebook, or alternatively, as a substitute for Lloyd's algorithm.

Equitz describes a full search version and an alternative fast search version of PNN clustering. Pairs of clusters are progressively merged based on minimizing weighted distance between cluster centroids. The full search PNN algorithm begins with a separate cluster for each vector in the image and merges two clusters at a time until the desired size vector codebook is achieved. For the fast-search version Equitz uses a data structure known as a K-d tree to reduce the scope of searching to O(log N) choices by subdividing the training set into "neighborhoods" and only considering merging vector pairs having centroids in the same neighborhood.

Balasubramanian et al. describe an application of Equitz's clustering vector quantization technique for palette selection. Initial image colors form a training set of sample vectors. Pairwise nearest neighbor (PNN) clustering of the initial sample vectors then is performed until the number of vectors equals the desired number of output codewords. Cluster centroids are chosen to be output centroids. Clusters are merged to minimize means squared error between vectors. PNN searches are implemented using K-dimensional trees. A prequantization step partitions RGB space into cubes. Centroids of colors in each cube are treated as the sample vectors. Image-dependent activity criteria determine the size of the cubes and weight intercluster distances to improve visual quality.

Orchard et al. describe a binary tree algorithm for partitioning clusters. Total squared-error, weighted total squared-error and erosion-based weighting are criteria applied for improving quantization. A gamma-based corrected coordinate system is used for computation, and L,a,b and L,u,v coordinate systems are proposed as alternative coordinate systems.

An alternative to the recursive bipartitioning methods of Equitz, Balasubramanian et al., and Orchard et al., is proposed in "Color Quantization by Dynamic Programming and Principal Analysis;" Xiaolin Wu, *ACM Transactions on Graphics*, Vol. 11, No. 4, October 1992. Wu proposes partitioning based on halfplanes set normal to a principal axis along which color points have maximum variance. Quantization is carried out in L*u*v space.

Pixel Mapping Techniques

Once a palette is selected, the pixels forming an image are mapped to the palette. Each pixel value of the original image is compared to the palette colors. An 8-bit index to a color in the palette closest to the original color is assigned to each pixel. By using 8-bit values for each pixel rather than 24 bits or 18 bits, the image consumes approximately one-third the memory of a full-color display subsystem.

Selection of one of the 256 colors in the palette is referred to as pixel mapping. In "Color Quantization of Images;" *IEEE Transactions on Signal Processing*, Vol. 39, No. 12, December 1991; Orchard et al. describe pixel mapping techniques for improving image quality. According to an "ordered dithering" technique, a pseudo-random noise pattern is added to blocks of pixels before quantizing them. According to an "error diffusion" technique, the image is quantized to have an average value substantially equal to the average value of the true image. In effect, these techniques allow a larger total squared error so that average color of the displayed and original images can be closely matched.

The Palette Management Problem

The problem of how to deal flexibly with color-mapped images has limited the potential of imaging applications on 8-bit display subsystems. (By 8-bit display subsystem, it is meant color-mapped display subsystems using an 8-bit index into a k-color palette (e.g., 256-color) of j-bit colors (e.g., 18-bit color resolution, 24-bit color resolution). For example, the task of simultaneously displaying two images with different palettes on an 8-bit display subsystem is so formidable that most applications and user interfaces do not allow such capability. Conventional applications displaying two images use the palette from one image to display the other. The image quality of the other image typically suffers from unacceptable levels of distortion. Accordingly, there is a need for a technology which effectively manages palettes from multiple images to enable simultaneous display of a plurality of minimally-distorted color quantized images.

SUMMARY OF THE INVENTION

According to the invention, a computer system including a color-mapped display subsystem combines palettes of multiple images into a single shared palette. Requests for the simultaneous display of multiple images using a shared palette are serviced in real time. Alternatively images are redefined using a shared palette and stored for later recall.

During palette selection of a given image, the image receives a degree of distortion as 256 colors are selected to represent the potentially millions of colors in the true image. It is an object of the invention to minimize further distortion when modifying the palettes to define a shared palette for displaying the images simultaneously.

According to one aspect of the invention, the colors included in the palettes are redefined into a set of 256 colors. To do so, colors are merged to redefine a color which minimizes distortion. In a preferred embodiment colors are merged two at a time.

According to one aspect of the invention, an efficient distortion measure is used to select which colors among the multiple palettes are combined when defining a shared palette. It is known to measure distortion using variations in color defined by RGB components (i.e., in an RGB cartesian coordinate space). However, variations in RGB color space do not correlate well to variations perceived by the human eye. Thus, an alternative reference space is used—the YIQ (or YUV) color space defined by the NTSC color television standard. YIQ space variations have a stronger correlation to variations perceived by the human eye. Also, YIQ space is a linear transform of RGB space. Thus, centroids of vectors in YIQ and RGB space are the same. All calculations other than distortion remain in RGB color-coordinate space to take advantage of the convenience of using the RGB orthonormal, cartesian-coordinate space. The distortion measure used as a decision criteria in combining colors is the mean-squared error distortion measure of gamma-corrected values defined in YIQ space.

According to another aspect of the invention, a pairwise nearest neighbor (PNN) technique is used for combining palette colors. Palette combination is modeled as a vector quantization problem. Respective palettes are taken as an initial vector training set of 256*n color vectors, (where n is the number of image palettes being combined and 256 is the number of colors forming a palette). The 256*n vectors are compressed into a single 256-color palette. To enable run-time application, the maintenance of K-d trees as taught by Equitz, Orchard et al. and Balasubramanian et al. during palette selection are avoided. It was found that maintenance of K-d trees requires an undesirably high constant searching time factor in combining vectors. The method of this invention, which addresses palette management, instead defines a matrix of distortion values for each vector pair.

For a final 256-color shared palette, up to 256 (n−1) individual vector merges are performed (where n is the number of image palettes being combined). At each step, two vectors are chosen that yield the lowest increase in distortion when merged. Out of $O(N^2)$ pairs to merge, where N=n*k, searching time at each step is reduced to O(N). Because distortion value are stored in the matrix, the need for extensive recalculation of vector pair distortions between merge steps is substantially reduced. Reducing the search time and recalculation of distortion pairs at each step results in an efficient combining method operable in real time. Efficiency is further enhanced because distortion calculations are cached between merge steps.

According to another aspect of the invention palettes for respective images are combined at run-time or are pre-combined to form a shared palette. When pre-combined, each image is stored as a new image using the shared palette. The multiple images subsequently are recalled for simultaneous display.

The most distinct advantage of the invention is the ability to service run-time demands for the simultaneous display of multiple images on a personal computer or workstation platform having an 8-bit color-mapped display subsystem. Previously, multiple images simultaneously displayed have used the palette of one of the images. Embodiments of this invention produce multiple images of better quality because an optimal shared palette is defined.

The aspects and advantages of the invention will be better understood by reference to the following detailed description taken in conjunction with the accompanying drawings.

BRIEF DESCRIPTION OF THE DRAWINGS

FIG. 5 is a depiction of an N×N matrix of distortion values among N=n*k colors; and FIG. 6 is a depiction of a minimum distortion pair array of color pairs according to an embodiment of this invention.

DESCRIPTION OF SPECIFIC EMBODIMENTS

Host Computer System

Figure 1:
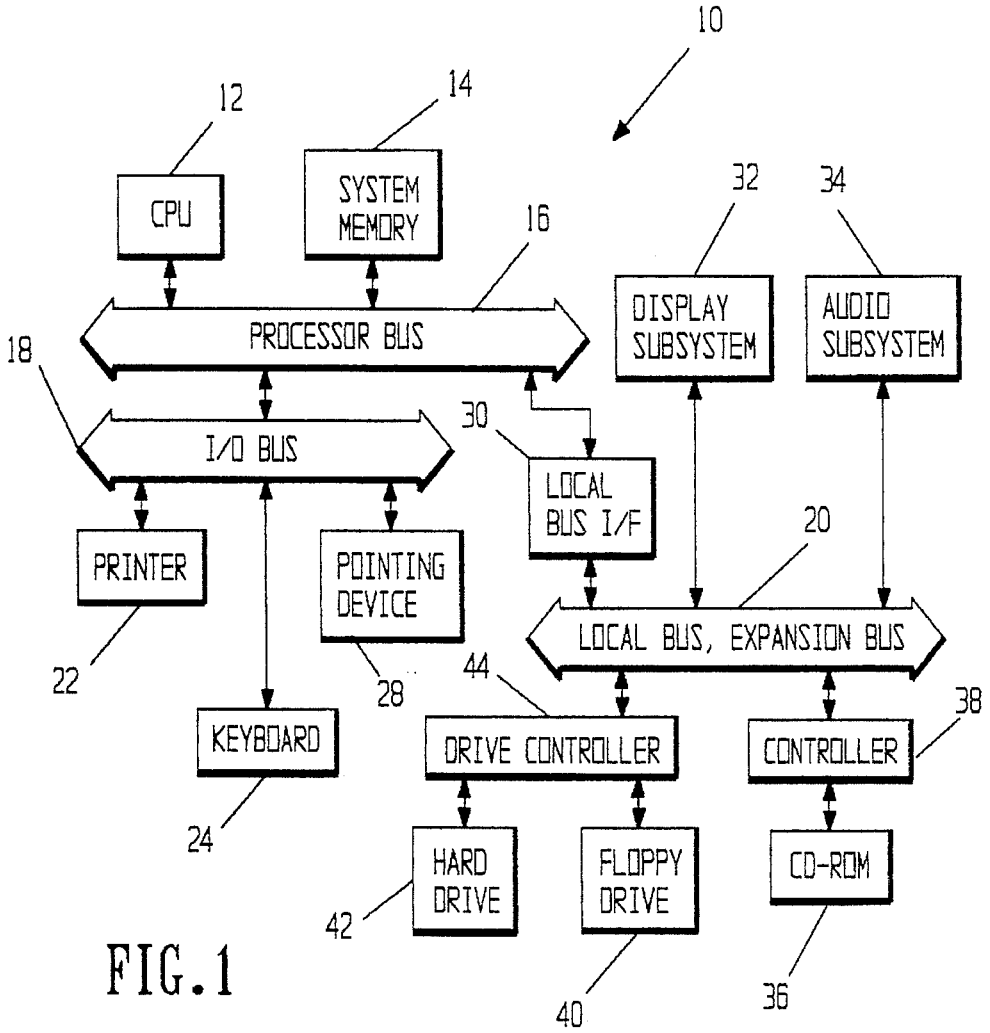
FIG. 1 is a block diagram of a host computer system for implementing an embodiment of the method and apparatus of this invention.

FIG. 1 shows a computer system 10 serving as a host for implementing an embodiment of this invention. The computer system 10 includes a central processing unit 12, system memory 14, multiple communication busses 16, 18, 20 and several system components and peripherals. According to preferred embodiments, the computer system 10 is a work station, personal computer, or any of several other standardized and proprietary general purpose or embedded microcomputers. Embodiments of the invention may be hosted on many alternative single or multiple microprocessor-based computer system architectures, including proprietary and open-standard work stations, IBM-compatible personal computers, PENTIUM™ machines, APPLE MACINTOSH™ machines, and other microcomputer machines currently available or to come based on the Intel 80X86 architecture, Motorola 68XXX architecture, other CISC processor architectures, and oncoming RISC processor and multiprocessor architectures. Operating system and environment platforms include DOS, Windows, OS/2, System VII, UNIX and other open or proprietary platforms. In alternate embodiments the computer system 10 may comprise a minicomputer or a mainframe computer system architecture.

The number and types of communication busses, system components and peripherals may vary. For the system 10 shown, there is a processor bus 16, I/O bus 18 and local bus and/or expansion bus 20. The CPU 12 and system memory 14 (e.g., external cache and system RAM) are located on the processor bus 16. The I/O bus 18 is linked to the processor bus 16 for interfacing to I/O ports. A printer 22, keyboard 24 and pointing device 28 (e.g., mouse) typically are coupled to the I/O bus 18 via I/O ports (not shown).

A local bus and/or expansion bus 20 are linked to the processor bus 16 via a bus interface 30. Exemplary local busses are the video local (VL) or VESA-standard bus, the peripheral component interface (PCI) bus and the NU-BUS. The PCI bus, for example, may couple up to 10 peripheral devices. Illustrated are a display subsystem 32, audio subsystem 34, CD-ROM 36 and controller 38, and floppy drive 40, hard drive 42 and drive controller 44. Typically an expansion bus is linked to the processor bus 16 via the local bus 120.

Color-Mapped Display Subsystem 32

Figure 2:
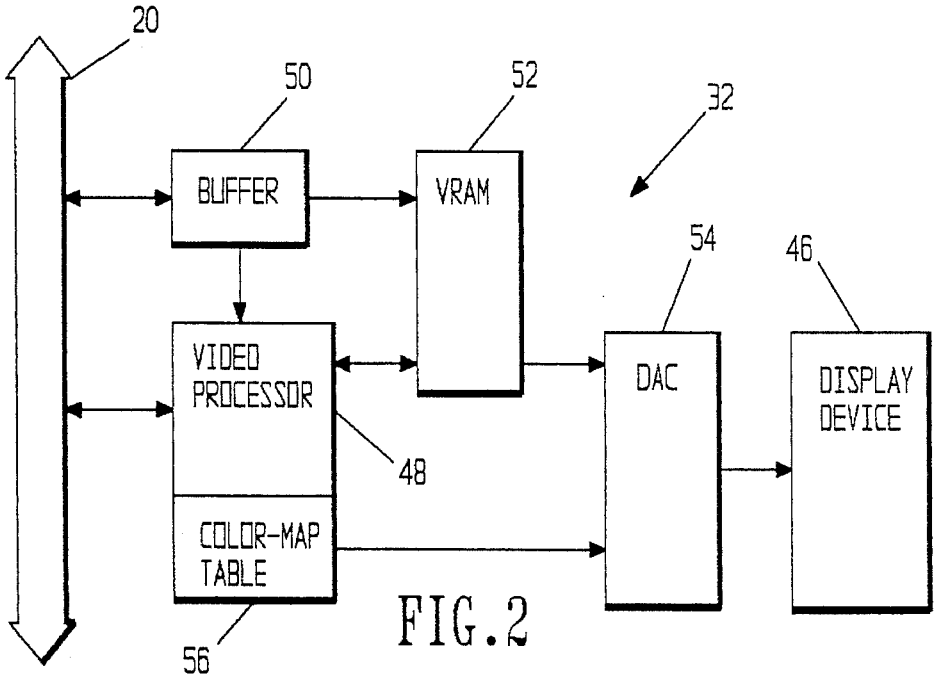
FIG. 2 is a block diagram of a color-mapped display subsystem of the computer system of FIG. 1.

FIG. 2 shows a color-mapped display subsystem 32 interfaced to the computer system 10. The display subsystem 32 controls the output of video signals to a display device 46. Typical display devices include cathode ray tubes (CRTs), or LED-based, transistor-based, or plasma-based display panels. The subsystem 32 includes a display device 46, video processor 48, buffer 50, VRAM 52 and video DAC (digital to analog converter) 54. A color-map table 56 is formed by storage elements integral or hard-wired to the video processor 48.

The video processor 48 receives commands from the host to define an operating mode or to process graphical commands. Image data is input from the host into a buffer 50 via the bus 20. The data is then routed into video RAM (VRAM) 52 by the video processor 48. Alternatively, the host maps the image data directly into VRAM 52.

According to a color-mapped display subsystem, an image is defined by a palette and a bit-map. Typically, the palette is formed by a set of 256 j-bit colors. Common display systems are 16-bit, 18-bit or 24-bit colors systems. 18-bit and 24-bit colors are the most common for 8-bit color-mapped display subsystems. The bit-map is formed as a set of 8-bit indexes into the palette. Each element in the bit-map corresponds to a pixel of the image to be displayed. To generate an image, each element is read from the bit-map and mapped to the palette color corresponding to the 8-bit index value. The selected color then is generated on the display for such pixel When all the pixels are "painted," an image is perceived.

The subsystem 32 receives the image data bit-map and palette from the host. The palette is loaded into the color-map table 56. The bit-map is loaded into VRAM 52. A stream of index data is processed by mapping the indices to the palette. Addressed palette colors are output to the DAC 54 as a stream of digital color signals. The DAC 54 converts the digital color signals into standard analog output signals (e.g., RGB signals) for driving the display device 46.

In one embodiment, palettes of multiple images are combined by the host system 10's CPU 12. The shared palette then is loaded into the display subsystem 32 in place of the predefined palette. According to another embodiment, however, multiple images and respective palettes are received by the display subsystem 32 before the palettes are combined. The video processor 48 combines the palettes to define a shared palette which is stored in the color-map table 56. Palette combination as a feature of the video processor 48 is embodied as a fixed mode, a selectable operating feature/mode, or simply a video command transmitted by the host CPU 12.

Procedure for Displaying Multiple Images

Figure 3:
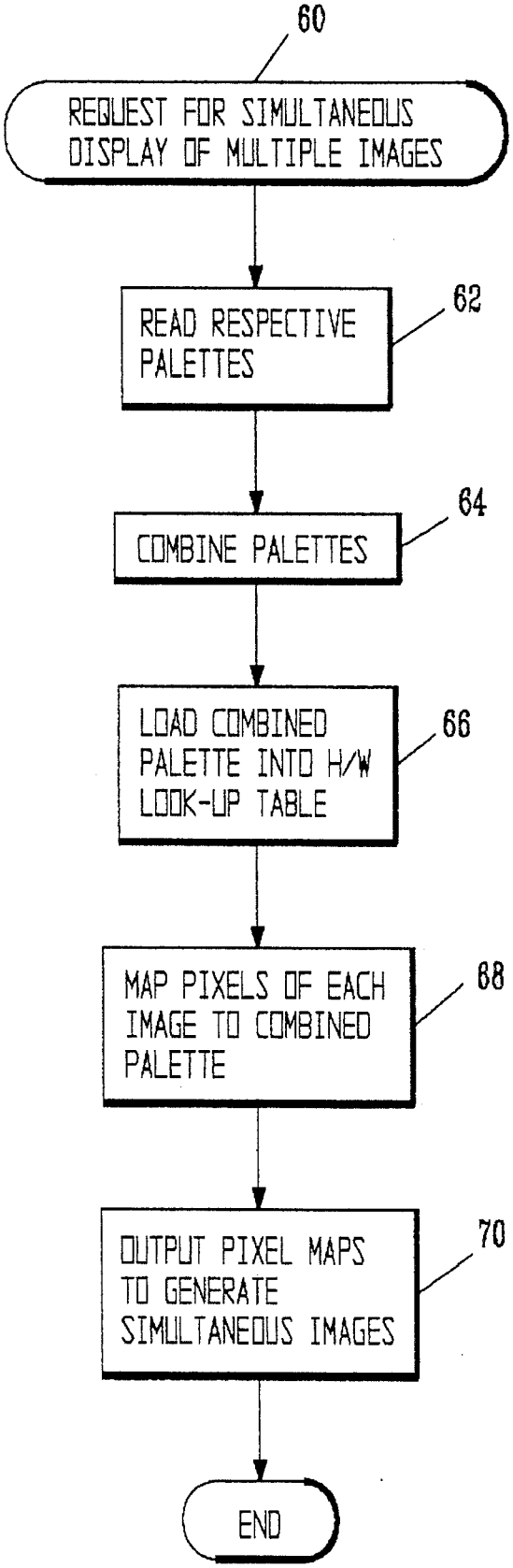
FIG. 3 is a flow chart of a method for servicing a request to simultaneously display multiple images on the display subsystem of FIG. 2.

FIG. 3 shows a flow chart of the procedure for servicing a run-time request for simultaneously displaying multiple images. According to conventional practices, when an image is scanned it is stored in a digital format. For color-mapped systems, the scanning software is set to generate a palette of colors (e.g., 256 colors) used in displaying the image. The image is stored in memory as a bit-map of indexes and a palette. Full-color images are converted using conventional utility software into 8-bit images (i.e., bit-map of 8-bit indexes, plus 256 color palette of j-bit color resolution, where j is typically, 16, 18 or 24). Standard image formats include TGA, DIB, GIF and TIFF.

At step 60 a request is made for the simultaneous display of multiple images using a combined palette. As the number of images to be simultaneously displayed increases, added distortion and processing time increases.

At step 62, the respective palettes for each image are read. At step 64, the individual palettes are combined into a shared palette according to an embodiment of the method of this invention (see FIG. 4 and discussion below in the section, Method for Combining Palettes). At step 66, the combined palette is loaded into the color-map look-up table 56. At step 68, a pixel map referenced to the combined palette is generated for each image according to conventional pixel mapping techniques. At step 70 the pixel map(s) are processed to generate RGB signals for simultaneously displaying the multiple images.

In an alternative embodiment for non-real time applications, step 60 differs. At such alternative step, multiple images to share a palette are identified. The multiple palettes then are combined according to an embodiment of the invention, (See FIG. 4). The images then are re-mapped to the shared palette. Later one or more of the images are output for display—serially or concurrently. In an exemplary application multiple related images (e.g., cars or faces) are to share a common palette. The images as re-mapped to the shared palette are output as selected by a user, (e.g., one at a time; multiple images concurrently displayed).

Method For Combining Palettes

Figure 4:
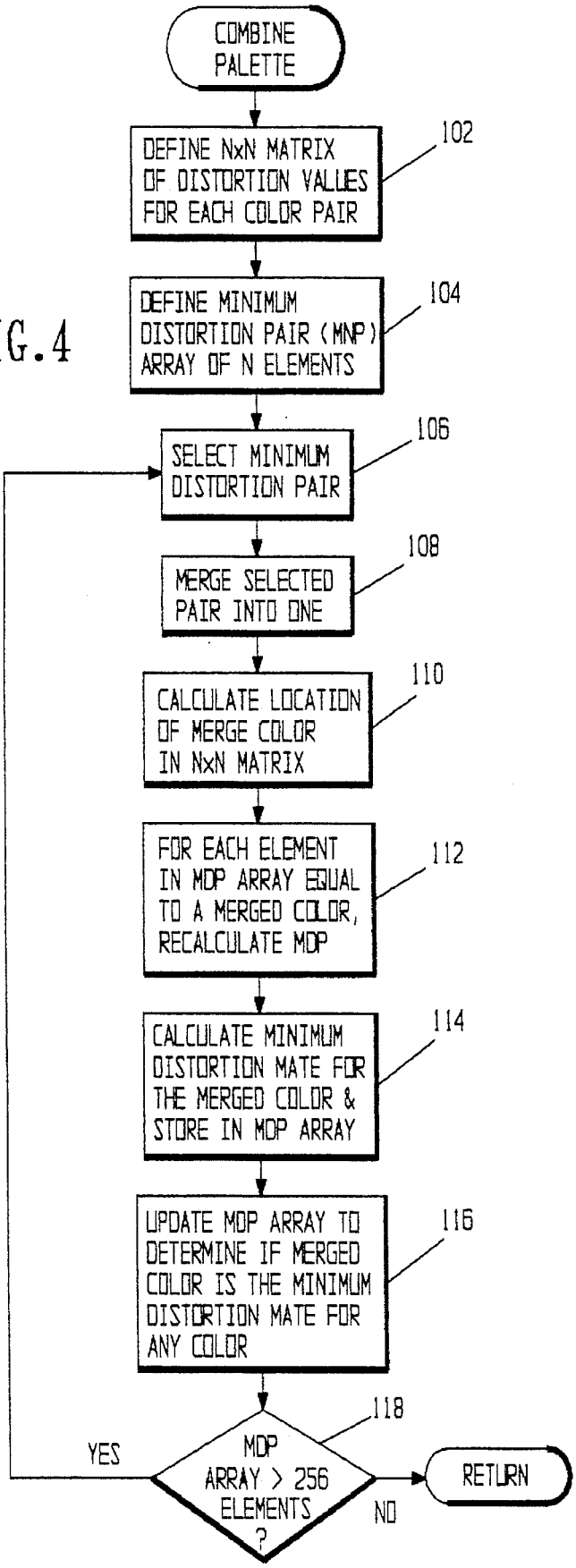
FIG. 4 is a flow chart of a method for combining palettes of color quantized images according to an embodiment of this invention.

FIG. 4 shows a flow chart of a computer program for combining a plurality of palettes into a single shared palette. The program is an implementation of a pairwise nearest neighbor (PNN) vector quantization method. According to the method, each color in each palette is treated as a vector. For palettes including 256 colors, a set of "256×n" vectors is compressed into 256 vectors, where n is the number of palettes to be combined (and also, the number of images to be simultaneously displayed). Iterations are executed during which two colors of similar appearance are merged into one color. Eventually enough colors are merged to shrink the set to 256 colors. Such set is the shared palette. To select which two colors are merged, distortion between colors are derived and the color pairs offering minimal distortion are combined. The distortion measurement is described below.

DISTORTION MEASUREMENT

The criteria used for selecting two colors to merge is distortion. Distortion is a variation in the image from its true image. At the pixel level, distortion is a change in color. For example, a true image may comprise perhaps millions of colors. When scanned and stored in a color-mapped display subsystem, the colors used to represent the image are limited to a 256-color palette. The variation between a palette color and the true color for a given pixel is distortion. A degree of distortion is introduced when a palette is selected for a true image. It is desirable to minimize the introduction of additional distortion during the palette combination method of this invention.

At each step of the palette combination method, there are between 256(+1) and 256*n colors. Two colors are selected for merging. Of all the possible choices of pair mergings, the pair selected are the two colors having the least distortion between them. The new color is a weighted centroid average of the colors. For the palette combination method to be effective in achieving simultaneous images with minimal distortion, it is desirable that the distortion measure be perceptually meaningful (i.e., be based on a color differential measure perceivable to the human eye). So that palettes can be combined in real time, it also is desirable that the measure be computationally efficient.

When multiple images are displayed simultaneously, the images typically are reduced in size. When an image is reduced, the ability of the human eye to perceive distortion is reduced. Thus, some minimal degree of distortion often can be introduced without it being meaningful to the human eye. Added distortion from the new combined palette thus is offset to some extent by decreases in image size.

In measuring distortion, color variations are defined in a 3-dimensional coordinate space. Such variations are distances in such space. For the distance to be meaningful, it is desirable that the coordinate system correlate to perceptive ability of the human eye. The most convenient color space is the 3-dimensional RGB orthonormal, cartesian-coordinate, color space.

RGB color space is formed from the RGB video signals in a color-mapped display subsystem. Every display color is defined as a component of red (R), green (G) and blue (B) signals for exciting red, green and blue phosphors. The red, green and blue phosphurs comprise a pixel element. For colors represented by 24 bits, 8 bits typically are allocated to each of the red, green and blue color components. In systems using a number of bits not divisible by three, red or green is the color typically represented by an additional bit. This is because the human eye is able to perceive variations at the red end of the spectrum easier than variations at blue end of the spectrum.

Unfortunately, RGB color space is already an abstraction of the physics of color and is not a useful indicator of distortion. Geometric distances in RGB color space do not correlate well to differences in color perceivable to the human eye. Identical RGB distances at different locations in RGB space may not be perceived the same.

To retain the convenience of RGB color space and improve the effectiveness in correlating to human perceptivity, a linear transform of RGB space is used in the preferred embodiment for measuring distortion. Because the spaces are linear transforms, centroids in one space remain centroids in the other space. Thus, the transformed space is used for measuring distortion, while RGB color space is used for other calculations.

The preferred color spaces for measuring distortion are the YIQ and YUV color spaces. The coded embodiment described herein uses the YIQ color space, which is defined by the NTSC color television standard. Its perceptual significance was one of the factors considered in designing the standard. The Y component represents the luminance of a color (i.e., brightness), while the I and Q components represent chromaticity (i.e., tint and hue).

According to one aspect of this invention, a weighted mean-squared error of RGB gamma-corrected values transformed into YIQ color space is used to represent distortion between two colors. Y, I and Q are defined as linear functions of R,G and B as represented below in formulae I, II and III.

$$Y_i=0.30*R_i+0.59*G_i+0.11*B_i \quad \text{(I)}$$

$$I_i=0.60*R_i-0.28*G_i-0.32*B_i \quad \text{(II)}$$

$$Q_i=0.21*R_i-0.52*G_i+0.31*B_i \quad \text{(III)}$$

As the range of values for R, G and B are finite, the nine factors (0.30*R, 0.59*G, . . . ) are predefined in a preferred embodiment in look-up tables. Such step saves processing time. The calculation of Y, I and Q for each color becomes a simple addition operation due to the predefined look-up tables. The distortion, D, then is calculated in real time according to formula IV. Distortion, D, is calculated as a weighted mean-squared error measure.

$$D=(5/8)(Y_1-Y_2)^2+(3/16)(I_1-I_2)^2+(3/16)(Q_1-Q_2)^2 \quad \text{(IV)}$$

Note that the weighting constants (i.e., 5/8, 3/16) may be tuned for different applications. For example, if the method is implemented for an application combining palettes of multiple facial images (e.g., rolodex application), then the constant for the "I" variable may be larger because faces include more red colors and reds show up in the "I component.

IMPLEMENTING THE PNN TECHNIQUE

To concurrently display a plurality of n images, the n corresponding palettes of k=256 colors each are combined to form a shared palette of k=256 colors. Thus, a set of N=n*k colors is reduced to a set of k colors. The k colors of the shared palette may be colors previously found among the n palettes or be new colors defined by merging colors.

Referring to FIG. 4, at step 102 an N×N matrix of distortion values is defined. Thus, the distortion between each one of N colors relative to every color (or every other color) is derived and stored in the matrix. An exemplary matrix is shown in FIG. 5. The matrix 103 comprises N rows of colors $C_1$ through $C_{n*k}$ and N columns of the same colors $C_1$ through $C_{n*k}$, where N=n*k; n=number of concurrent images; and k=256 colors per palette. The distortion value between color $C_i$ and color $C_j$ is designated as D(i,j) or D(j,i), and defined according to formula IV above. As the matrix is symmetrical, it can be reduced to a triangular matrix to reduce storage space and computation time. Note that the distortion between the same colors (e.g., $C_i$ and $C_i$) is "0". Thus, the matrix diagonal D(i,i) is filled with "0's".

At step 104, each row (i=1,N) of the matrix is searched to find the lowest distortion. The two colors defining the lowest distortion entry form a minimum distortion pair for such row. For linguistic convenience, one color is referred to as the row color or $i^{th}$ color and the other color is referred to as the mate color. According to a preferred embodiment, all values in the row other than the value of a diagonal element are tested, (e.g., for row 2, all elements but the element in column 2 are considered). Thus, for each row color, the remaining N−1 other colors are tested to find which one is to be a mate color. The row color (i.e., $i^{th}$ color) and mate color define a minimum distortion pair.

Because of the low probability of duplicate colors, the N colors are not first reduced to eliminate duplicates. Such duplicates would be the first to be merged anyway, as they result in the least distortion. In alternate embodiments of the invention, elimination of duplicates may be performed before identifying minimum distortion pairs or before merging colors.

Referring to FIG. 6, a minimum distortion pair ("MDP") array 105 is defined in which each row i of the array corresponds to the row color ($i^{th}$ color) of the matrix 103. The element stored in the array represents the mate color and/or the distortion between such row color and mate color. At step 106 the MDP array 105 elements are tested to find the lowest distortion value among the minimum distortion pairs. At step 108 the pair of colors corresponding to such lowest distortion value are merged into a single replacement color. Such new color is defined as an occurrence-weighted average of the centroids of the two colors according to Formulae V-VIII below:

$$C_R(R_C,G_C,B_C)=Centroid\ (C_x,C_y) \quad \text{(V)}$$

$$R_C=[R_x(L_x)+R_y(L_y)]/(L_x+L_y) \quad \text{(VI)}$$

$$G_C=[G_x(L_x)+G_y(L_y)]/(L_x+L_y) \quad \text{(VII)}$$

$$B_C=[B_x(L_x)+B_y(L_y)]/(L_x+L_y) \quad \text{(VIII)}$$

where $C_R$=replacement color as a function of R, G, B;

$R_C$=red component of replacement color;

$G_C$=green component of replacement color;

$B_C$=blue component of replacement color;

$C_x$=row color of minimum distortion pair;

$C_y$=mate color of minimum distortion pair;

$R_x$, $R_y$=red components of $C_x$, $C_y$, respectively;

$G_x$, $G_y$=green comp. of $C_x$, $C_y$, respectively;

$B_x$, $B_y$=blue components of $C_x$, $C_y$, respectively;

$L_x$=# of occurrences of color $C_x$ in n images;

$L_y$=# of occurrences of color $C_y$ in n images;

A step 110, the N×N matrix is updated. Once two colors are merged, the values for such colors in the N×N matrix and minimum distortion array are no longer needed. To maintain storage efficiency, the replacement color receives the number of one of the merged colors. For example, if colors $C_{20}$ and $C_{40}$ are merged, the replacement color, $C_R$, becomes color $C_{20}$. Distortion values D(R,j) then are calculated between the replacement color $C_R$ and every other color and stored in the matrix within row 20 and column 20. In addition, the last color in the matrix (e.g., $C_N$) is redefined as color $C_{40}$. The values for $C_N$ in row N and column N are moved into row 40 and column 40. Also, the value for color $C_N$ in the MDP array is moved to row 40 of the MDP array. Address changes for values in the MDP array effected by moving $C_N$ to $C_{40}$ also are updated to point to the new location.

At step 112, the elements in the MDP array 105 are updated for each element in which either one of the two merged colors served as a mate color. In any case where a merged color served as a mate color, the row color and row of the updated N×N array are tested to determine whether the replacement color defines a minimum distortion pair with the row color. If so, the replacement color becomes the mate color, and the row color and replacement color form an updated minimum distortion pair. Thus, the value stored in the MDP array is updated to correctly identify the minimum distortion pair.

At step 114, a minimum distortion pair for the replacement color is determined and stored in the MDP array 105. Specifically, a mate color is identified by scanning the replacement color's row (e.g., row 20) in the N×N matrix to find the minimum distortion value. Such distortion value or mate color is stored in the MDP array in a row for the replacement color (e.g., row 20).

At step 116, the MDP array 105 is updated by testing whether the replacement color defines the minimum distortion pair with any of the row colors. To do so, the distortion corresponding to the stored minimum distortion pair is compared to the distortion between the row color and the replacement color. If the distortion between the row color and replacement color is lower, then the replacement color becomes the mate color to define an updated minimum distortion pair.

At step 118 the length of the MDP array 105 is tested to see if the set of N colors has been reduced to k colors yet. If there still are more than k colors, a new iteration of steps 106 to 118 are performed. In an alternative embodiment, the test for another iteration is performed after step 108, and if another iteration is needed execution of steps 110–116 occur followed by a return to step 106. When only k colors are left, the k colors represent the shared palette.

In an alternative embodiment more than two colors may be merged during a given iteration. According to such alternative, when a selected minimum distortion pair is identified for merger, the MDP array first is re-scanned to find additional colors to merge. Additional colors are selected that are paired with the row color or mate color of the minimum distortion pair (referred to herein as a link criteria). Specifically, the other minimum distortion pairs in the array are tested to identify pairs having the row color or mate color of the selected minimum distortion pair. The additional color then is included among the colors to be merged. In one embodiment, the number of colors to be merged during one iteration is limited to a fixed value, (e.g., 4 colors, 8 colors). In another embodiment, the number to be merged during a single iteration is limited only by the failure to satisfy the link criteria. Each time additional colors are identified for inclusion among the colors to be merged, a new test is executed in which the rest of the MDP array is scanned to find pairs including a color among the group of colors to be merged (according to the link criteria). Eventually, there are no more colors that satisfy the link criteria. For embodiments merging more than 2 colors during a single iteration, the number of colors remaining is tested to determine whether merging would result in fewer than k=256 colors. As the final palette is to include k=256 colors it is not desirable to get to a number less than 256. For embodiments limiting the merger to a fixed number of colors, f, the feature is disabled when the number of colors remaining is less than 256+f. For embodiments only limited by the link criteria, the number of colors is tested each time another color is selected for merger.

In practice it was found that the alternative embodiments allowing for more than 2 colors to be merged resulted in a similar shared palette. More specifically, the colors included with the initial two colors selected for merging usually ended up being merged with the replacement color in a later iteration anyway. Thus, the different embodiments had similar effect.

In the preferred embodiment, the number of colors merged during a single iteration is limited to two. It was found in practice that the computation time savings associated with the fewer iterations needed to achieve k=256 colors was offset by the computation overhead associated with finding additional colors to be merged. Thus, the embodiment limited to merging two colors is the most efficient.

PALETTE COMBINATION SOFTWARE

In a preferred embodiment, the palette combination software is written in a "C" programming language in a manner providing fast, efficient code as would be appreciated by a programmer skilled in the art of image processing and video subsystem design. A source code listing of an embodiment used in creating experimental results is attached as Appendix A.

Pixel Mapping

Once a shared palette is defined, the images to be concurrently displayed are remapped to the new palette at step 68, (see FIG. 3). As previously described, each image includes an index bit-map and a palette. An index for a particular pixel in the bit-map points to one of k colors in the palette. Once the shared palette is defined, the bit-map is redefined. In one embodiment, the color in the shared palette closest to the original palette color is identified and its index stored. According to another embodiment, conventional pixel mapping optimization is performed using ordered dithering or error diffusion as referred to in the background section. According to another embodiment, each time a palette color is merged a replacement color is substituted in a virtual palette of the image. When the shared palette is complete, each of n virtual palettes include only k colors. The order of colors in the virtual palettes differ, though. The virtual palettes are then transposed (i.e., rearranged) to the order of the shared palette. At each step in the transposition, the indices in respective bit-maps to a transposed color are transposed to point to the same color in the shared palette. When the virtual palettes are completely transposed, the bit-maps also are completely transposed.

Experimental Results

The following tables show run times and distortion measures resulting when combining palettes of multiple images. Table I lists run time in CPU seconds on the SPARCstation 2. CPU run time of the palette combining software is substantially independent of image size and content, depending merely on the number of palettes being combined.

TABLE I

| No. of Images | Time to Combine |
|---|---|
| 2 | 3.4 seconds |
| 3 | 8.4 seconds |
| 4 | 15.2 seconds |

The test images are taken from a USC test image set and are titled: F16, Fruits, Lena, and Yacht. F16 is an image of an aircraft; Fruits is an image of fruit; Lena is an image of a woman; and Yacht is an image of a large sailboat. Color-mapped versions of the images were quantized directly from 24-bit full-color test images using methods described by Orchard et al. (See background of the invention section). Table II gives the distortions introduced during this initial palette selection (i.e., image quantization) step.

TABLE II

| Image | Distortion per Pixel |
|---|---|
| F16 | 4.07 |
| Fruits | 7.73 |
| Lena | 4.28 |
| Yacht | 8.13 |

Each distortion value is measured against the original 24-bit full color image and normalized by image size (to per pixel distortions). For purposes of comparison, distortion is calculated using Formulae V–VIII (See section titled "Distortion Measurement."

Tables III, IV and V list the image distortions resulting from combinations of 2, 3 and 4 images, respectively, according to the palette combination method of this invention. Comparing the distortion values of Tables III, IV and V to the distortion values in Table 2, one observes that little distortion is added by the embodiment of this invention. This is particularly surprising considering that the measured distortion of a given pixel is related to the square of the geometric distance in color space representing the change in pixel color value. Further, the perceived (subjective) distortions added by the embodiment are quite mild and not distracting.

TABLE III

| Image | F16 | Fruits | Lena | Yacht |
|---|---|---|---|---|
| F16 | — | 6.49 | 6.20 | 6.43 |
| Fruits | 8.93 | — | 6.39 | 9.69 |
| Lena | 5.39 | 6.49 | — | 6.46 |
| Yacht | 9.16 | 9.75 | 9.58 | — |

TABLE IV

| Image | Distortion Per Pixel |
|---|---|
| F16 | 7.57 |
| Fruits | 10.65 |
| Lena | 7.75 |

TABLE V

| Image | Distortion Per Pixel |
|---|---|
| F16 | 8.24 |
| Fruits | 12.63 |
| Lena | 9.02 |

TABLE V-continued

| Image | Distortion Per Pixel |
|---|---|
| Yacht | 12.42 |

Problem and Means for Solving Problem

A significant problem with 8-bit color-mapped display subsystems is the inability to simultaneously display multiple images of good quality. In a conventional application allowing multiple images to appear on the display at the same time, all images use the predefined palette of one image. Such predefined palette was selected to minimize distortion for its corresponding image. However, use of the predefined palette colors for other images typically results in significant distortion of the other images. Some applications do not even re-map the other images to the predefined palette producing nonsensical images with faint resemblance to its true image.

The invention addresses these prior limitations by combining predefined palettes of each image to be displayed concurrently. To combine the palettes, colors among the palettes are merged. The resulting shared palette may include colors from the predefined palettes and new colors defined by merging colors among the predefined palettes. The criteria used for selecting a pair of colors to merge is a measure of the distortion between the colors. At each step, the two colors having the lowest distortion between them are merged. The replacement color is an occurrence-weighted average of the respective color's centroids. Thus, if a first color occurs 10 times among the images and a second color occurs only once, the replacement color will be closer to the first color then the second color. Once a shared palette is defined, the images are remapped to the shared palette and displayed.

According to various embodiments, the combining method is a user selected display option, or an operating mode, or a video processor command. The method may be implemented in an application program executed by a host processor or be a command feature of a video processor.

Meritorious and Advantageous Effects

One advantageous effect of the invention is the ability to perform the palette combination in real time for a given set of images. (As the number of palettes to combine increases, however, the computation time increases.)

A meritorious effect is that the images mapped to the shared palette can be stored as separate images from the corresponding 8-bit images with the predefined palettes. Accordingly, a presentation or multimedia display of known sequence can be enhanced by redefining concurrent images using the palette combining method, then storing such images (and shared palette). The remapped images then are recalled during the presentation to provide good quality images with no presentation delays attributable to the combined palette.

Although a preferred embodiment of the invention has been illustrated and described, various alternatives, modifications and equivalents may be used. For example, although an 8-bit color-mapped subsystem is typical, the principles of the invention apply to alternate embodiments of color-mapped subsystems of more than 8 bits or less than 8 bits. Although 16-bit, 18-bit and 24-bit color is typical for current color-mapped subsystems, the number of bits describing a given color may vary.

Also, although step 102 of FIG. 3 defines an N×N matrix where N is the total set of 256*n colors among the n palettes to be combined, the matrix can be reduced at a first step by eliminating duplicate entries, (i.e., duplicate colors are represented only once). As a result an M×M matrix is achieved, where M is some number less than or equal to N.

Also, although the YIQ and YUV color spaces are preferred when measuring distortion, other color space systems (e.g., RGB color space) may be used in alternative embodiments of the invention.

Beneficial applications include multimedia presentations and comparison displays. Multimedia applications, for example, often require concurrent display of multiple images. Such industry recognizes the problem of being unable to simultaneously display images on an 8-bit color-mapped display subsystem having satisfactory image quality. Comparison displays are particularly well-suited for the technology, as concurrent display of cars or other items would allow the user to have high quality images with little distortion added under as shared palette.

Therefore, the foregoing description should not be taken as limiting the scope of the inventions which are defined by the appended claims.

What is claimed is:

1. A method for concurrently displaying a plurality of images on a display device, comprising the steps of:

reading n palettes, each one of the n palettes being a respective digital palette of k colors corresponding to a respective one of n images;

grouping the n palettes into an initial colorset of n*k colors;

compressing the initial colorset which initially defines a current colorset into a shared palette of k colors comprising the step of iteratively merging a color pair from the current colorset into a corresponding replacement color to reduce the current colorset, only the color pair having a lowest minimum distortion value is merged during an iteration, the merged color pair being selected from a set of color pairs, the set of color pairs comprising a color pair for each color in the current colorset, each color pair of said set comprising a first color and a mate color, both the first color and mate color for each color pair comprising a color from the current colorset, the mate color being the remaining color from the current colorset having minimum distortion with the first color, the reduced colorset becoming the current colorset for the subsequent iteration, the corresponding replacement color for the current iteration becoming a first color, a mate color being defined for the replacement color, updating the set of color pairs by determining whether the replacement color for the current iteration is a mate color for any of the remaining first colors;

mapping each of said n images to the shared palette; and displaying at least a portion of two or more of said n images on the display device concurrently using the shared palette, wherein the steps of grouping, compressing and mapping are performed by a computer system in real-time with the step of displaying.

2. A method for displaying a plurality of images on a display device, comprising the steps of:

reading n palettes, each one of the n palettes being a respective digital palette of k colors corresponding to a respective one of n images;

grouping the n palettes into a colorset of n*k colors;

compressing the colorset into a shared palette of k colors comprising iteratively merging colors;

mapping each of said n images to the shared palette; and displaying at least a portion of two or more of said n images on the display device concurrently using the shared palette, wherein the steps of grouping, compressing and mapping are performed by a computer system in real-time with the step of displaying;

wherein the step of compressing comprises the steps of:

(a) for each one color in the colorset, calculating distortion between said one color and each remaining color in the colorset;

(b) forming a matrix of n*k rows for storing calculated distortions, each row for storing calculated distortion between a row color and each remaining color in the colorset, a row color being a respective one color of said n*k colors;

(c) for each row color identifying a mate color as the remaining color for which the calculated distortion is a minimum, said row color and corresponding mate color defining a minimum distortion pair, a set of minimum distortion pairs being formed by the minimum distortion pair for each said row color and corresponding mate color in the colorset, wherein a set of minimum distortions is formed by the respective minimum distortion corresponding to each respective minimum distortion pair;

(d) selecting from the set of minimum distortions a lowest minimum distortion value;

(e) merging the colors that define the minimum distortion pair corresponding to the selected lowest minimum distortion value into a replacement color to reduce number of colors in the colorset and form a reduced colorset;

(f) reducing said matrix by eliminating two rows which correspond to the merged colors;

(g) reducing said set of minimum distortion pairs by eliminating the merged minimum distortion pair;

(h) reducing said set of minimum distortions by eliminating the minimum distortion corresponding to the merged minimum distortion pair;

(i) determining distortion between the replacement color and each other color in the reduced colorset;

(j) adding a row to the matrix corresponding to the distortions between the replacement color and said each other color in the reduced colorset, said replacement color becoming one of said row colors;

(k) defining a mate color to the replacement color as one of said other colors in the reduced colorset that has a least distortion relative to the replacement color, said replacement color and corresponding mate color defining a minimum distortion pair;

(l) for each one minimum distortion pair of said set of minimum distortion pairs in which said one minimum distortion pair's mate color comprises any of the merged colors of a current iteration, updating the mate color of said one minimum distortion pair to be a remaining color in the reduced colorset which provides a minimum distortion;

(m) for each updated minimum distortion pair, updating the corresponding minimum distortion in the set of minimum distortions; and (n) iteratively repeating the steps of selecting, merging, matrix reducing, minimum distortion pair set reducing, minimum distortion set reducing, determining, adding, defining, mate color updating and minimum distortion updating until the step of merging results in a reduced colorset of k colors, the reduced colorset of k colors defining the shared palette.

3. An apparatus for concurrently displaying a plurality of images on a display device using a shared palette of colors defined by merging colors of individual palettes, comprising:

(a) means for storing a plurality of images color-mapped to respective palettes, each palette comprising k colors;

(b) means for displaying the plurality of images concurrently using a common palette;

(c) processing means receiving a plurality of n respective palettes corresponding to n respective stored images for executing a computer program for combining the n palettes of k colors each into a shared palette of k colors comprising the steps of:

grouping the n palettes into a colorset of n*k colors;

for each one color in the colorset, calculating distortion between said one color and each remaining color in the colorset;

forming a matrix of n*k rows for storing calculated distortions, each row for storing calculated distortion between a row color and each remaining color in the colorset, a row color being a respective one color of said n*k colors;

for each row color identifying a mate color as the remaining color for which the calculated distortion is a minimum, said row color and corresponding mate color defining a minimum distortion pair, a set of minimum distortion pairs being formed by the minimum distortion pair for each said row color and corresponding mate color in the colorset, wherein a set of minimum distortions is formed by the respective minimum distortion corresponding to each respective minimum distortion pair;

selecting from the set of minimum distortions a lowest minimum distortion value;

merging only the colors that define the minimum distortion pair corresponding to the selected lowest minimum distortion value into a replacement color to reduce number of colors in the colorset and form a reduced colorset;

reducing said matrix by eliminating two rows which correspond to the merged colors;

reducing said set of minimum distortion pairs by eliminating the merged minimum distortion pair;

reducing said set of minimum distortions by eliminating the minimum distortion corresponding to the merged minimum distortion pair;

determining distortion between the replacement color and each other color in the reduced colorset;

adding a row to the matrix corresponding to the distortions between the replacement color and said each other color in the reduced colorset, said replacement color becoming one of said row colors;

defining a mate color to the replacement color as one of said other colors in the reduced colorset that has a least distortion relative to the replacement color, said replacement color and corresponding mate color defining a minimum distortion pair;

for each one minimum distortion pair of said set of minimum distortion pairs in which said one minimum distortion pair's mate color comprises any of the merged colors of a current iteration, updating the mate color of said one minimum distortion pair to be a remaining color in the reduced colorset which provides a minimum distortion;

for each updated minimum distortion pair, updating the corresponding minimum distortion in the set of minimum distortions; and iteratively repeating the steps of selecting, merging, matrix reducing, minimum distortion pair set reducing, minimum distortion set reducing, determining, adding, defining, mate color updating and minimum distortion updating until the step of merging results in a reduced colorset of k colors, the reduced colorset of k colors defining the shared palette;

(d) a color-map table comprising memory storage for receiving the shared palette;

(e) video RAM for storing color-map data for said plurality of images; and (f) means for generating a video signal for concurrently displaying said plurality of images by reading in color-map data from said video RAM for said plurality of images and outputting a stream of color signals identified by said color-map data, the color signals defined by colors in the shared palette within the color-map table, the shared palette serving as the common palette.

4. The apparatus of claim 3, further comprising:

processing means for mapping each of said n images to the shared palette before the step of concurrently displaying the shared palette.

* * * * *